US006604801B2

(12) United States Patent
Park

(10) Patent No.: US 6,604,801 B2
(45) Date of Patent: Aug. 12, 2003

(54) APPARATUS FOR AND METHOD OF ADJUSTING A HEAD GAP IN AN INKJET PRINTER

(75) Inventor: Jin-ho Park, Yongin (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/198,139

(22) Filed: Jul. 19, 2002

(65) Prior Publication Data

US 2003/0122883 A1 Jul. 3, 2003

(30) Foreign Application Priority Data

Jan. 2, 2002 (KR) ..... 2002-0000113

(51) Int. Cl.[7] ..... B41J 25/308
(52) U.S. Cl. ..... 347/8
(58) Field of Search ..... 347/8, 19, 14, 347/23, 5, 9, 4, 16, 104–105; 400/59, 55, 56

(56) References Cited

U.S. PATENT DOCUMENTS 5,051,008 A * 9/1991 Honda et al. ..... 400/59
5,798,841 A * 8/1998 Takahashi ..... 358/296

* cited by examiner

*Primary Examiner*—Raquel Yvette Gordon
*Assistant Examiner*—Charles W. Stewart, Jr.
(74) *Attorney, Agent, or Firm*—Staas & Halsey LLP

(57) ABSTRACT

An apparatus for adjusting a head gap between printing paper and a nozzle of a printing head in an inkjet printer includes a carrier mounted with the printing head, a chassis having a carrier shaft guiding a movement of the carrier, an eccentric cam formed on one end of the carrier shaft, a carrier driving part moving the carrier right and left along the carrier shaft, and a paper-transporting roller driving part driving a paper-transporting roller of transporting printing paper to be printed. The apparatus includes a carrier ascent/descent part ascending and descending the carrier by rotating the carrier shaft, and a clutch device selectively transmitting a driving force of the paper-transporting roller driving part to the carrier shaft to rotate the carrier shaft and disposed to be actuated by the carrier which is moved by the carrier driving part when the head gap should be adjusted. Accordingly, the apparatus can automatically adjust the head gap by using only the driving force of the carrier driving part and the paper-transporting roller driving part without using a separate driving motor.

42 Claims, 7 Drawing Sheets

APPARATUS FOR AND METHOD OF ADJUSTING A HEAD GAP IN AN INKJET PRINTER

CROSS-REFERENCE TO RELATED APPLICATIONS

This application claims the benefit of Korean Application No. 2002-113, filed Jan. 2, 2002, in the Korean Industrial Property Office, the disclosure of which is incorporated herein by reference.

BACKGROUND OF THE INVENTION

1. Field of the Invention

The present invention relates to an apparatus for adjusting a head gap between printing paper and a nozzle of a printing head in an inkjet printer, and more particularly, to an apparatus for automatically adjusting a head gap according to a change in thickness of printing paper in an inkjet printer.

2. Description of the Related Art

Generally, an inkjet printer, as shown in FIG. 1, includes a printing head 30 having a nozzle 31 at a lower part thereof to eject ink through the nozzle 31, a carrier 20 mounted with the printing head 30 therein, and a chassis 10 having a guide rail 11 and a carrier shaft 50 both guiding a movement of the carrier 20. At a rear part of the carrier 20, a supporting bracket 51 and a guide slider 22 are formed to allow the carrier 20 to be movable right and left along the carrier shaft 50 and the guide rail 11, respectively.

Thus, when printing paper 40 passes below a lower part of the printing head 30 through a paper-transporting roller 60 after being picked up from a paper-storing tray or a cassette by a pick-up roller (not shown), the printing head 30 mounted in the carrier 20 is moved right and left along the carrier shaft 50 and the guide rail 11 to perform a printing operation of ejecting the ink onto the printing paper 40 through the nozzle 31. Discharging rollers 70, 80 are disposed at a paper discharging portion of the inkjet printer.

However, in the inkjet printer, a distance or a head gap between the printing paper 40 and the nozzle 31 of the printing head 30 is generally fixed. Accordingly, when the inkjet printer prints an envelope or a postcard having a thickness of two or three times greater than that of general paper, the head gap is considerably reduced compared with that of when the general paper is printed, and the printing head 30 may be tilted with respect to the envelope or the post card. In this case, a spread or smear of the ink resulting in a problem of deterioration of a printing quality may be generated.

To solve the above problem, in the conventional inkjet printer, an apparatus 90 which can manually adjust the head gap between the printing paper 40 and the printing head 30 according to the thickness of the printing paper 40 is installed as shown in FIGS. 1 and 2. The apparatus 90 includes a carrier guide 21 formed in the guide slider 22 at an upper part of the carrier 20, a cam 23 having a cam surface mounted on the carrier to move the carrier 20 with respect to the chassis 10, a compression spring 24 biasing the carrier guide 21 to come in contact with the cam 23, and a spring guide 25 receiving and supporting the compression spring 24.

In operation, when the envelope, the postcard and the like are printed, the head gap is to be increased, and the cam 23 is rotated in a direction B by a user to push the carrier guide 21.

At this time, since the spring guide 25 is fixed to the carrier 20, the carrier guide 21 is biased in a direction D by a repulsive power of the compression spring 24. However, since the guide slider 22 elastically coupled to the carrier guide 21 is disposed not to be movable back and forth but to be slidable right and left along the guide rail 11, the guide slider 22 is not moved, but the spring guide 25 is backward pushed as much as the eccentricity of the cam surface of the cam 23.

As the spring guide 25 fixed to the carrier 20 is backward pushed, the carrier 20 mounted with the printing head 30 is rotated in a direction C about the carrier shaft 50. As a result, front parts of the carrier 20 and the nozzle 31 of the printing head 30 are rotated about the carrier shaft 50.

On the contrary, when the general paper is printed, the head gap is to be decreased, and the cam 23 is rotated in a reverse direction. As a result, the carrier 20 is rotated about the carrier shaft 50 and descended into the former position.

However, since in the conventional inkjet printer, the front part of the carrier 20 is ascended or descended to increase or decrease the head gap, there was a problem that the nozzle 31 of the printing head 30 is arranged to be tilted with respect to the printing paper 40. In this case, since there exists a difference in height between front and rear ends of the nozzle 31 a deflection or variation in the printing quality can occur at beginning and ending portions of the printing paper 40 which is printed by the nozzle 31.

Although the conventional inkjet printer may adjust the head gap with the above explained structure, to adjust t,he head gap, the user has to move the cam 23 whenever the kind of the printing paper 40 is changed, and consequently an operation error as well as inconvenience and troublesomeness may occur.

To improve these problems, as shown in FIG. 3, there has been proposed a method of ascending and descending a carrier 20' by forming both ends 50'', 50''' of a carrier shaft 50' in the form of an eccentric cam having a given eccentricity δ and then connecting the carrier shaft 50' with a transmission (not shown) which is driven by a separate driving motor. However, since the method uses an additional driving motor and a transmission unit, a manufacturing cost increases, and an additional space for the driving motor and transmission is required, thereby resulting in an increase in size of the inkjet printer.

SUMMARY OF THE INVENTION

Therefore, it is an object of the present invention to provide an improved apparatus in an inkjet printer for adjusting a head gap between printing paper and a printing head according to a change in thickness of the printing paper.

It is another object to provide an improved apparatus in an inkjet printer for automatically adjusting a head gap between printing paper and a printing head by using only a driving force of a carrier driving motor and a paper-transporting roller driving motor without using a separate additional driving motor.

Additional objects and advantageous of the invention will be set forth in part in the description which follows and, in part, will be obvious from the description, or may be learned by practice of the invention.

These and other objects may be achieved, according to an embodiment of the present invention, by providing an apparatus for adjusting a gap between printing paper and a nozzle of a printing head ejecting ink on the printing paper in an inkjet printer. The apparatus includes a carrier mounted with the printing head, a chassis having a carrier shaft guiding a movement of the carrier, a carrier driving part moving the carrier right and left along the carrier shaft, a paper-transporting roller driving part driving a paper-transporting roller to transport the printing paper to be printed, a carrier ascent/descent part ascending and descending the carrier by rotating the carrier shaft with respect to the carrier and a clutch unit transmitting a driving force of the paper-transporting roller driving part to the carrier shaft and disposed to be actuated by the carrier which is moved by the carrier driving part when the gap should be adjusted.

The clutch unit includes a clutch part selectively transmitting the driving force of the paper-transporting roller driving part to the carrier shaft, and an actuator actuating the clutch part to transmit the driving force of the paper-transporting roller driving part to the carrier shaft.

The clutch part includes an eccentric rotation gear formed at one end of the carrier shaft and a clutch disposed at the chassis to connect or disconnect the paper-transporting roller driving part to or from the eccentric rotation gear. In this case, it is possible that the carrier ascent/descent part has both ends of the carrier shaft formed of in the form of an eccentric cam which a center axis thereof is eccentrically positioned as much as a given amount with respect to a center axis of the carrier shaft, supporting bushings formed at the chassis to rotatably support both ends of the carrier shaft to ascend and descend.

The clutch includes a first clutch gear engaged with the paper-transporting roller driving part, a second clutch gear coaxially connected with the first clutch gear and disposed to be movable between a power-connected position engaged with the first clutch gear and the eccentric rotation gear and a power-disconnected position separated from the first clutch gear, and an elastic spring elastically pushing the second clutch gear to be positioned in the power-disconnected position.

The actuator includes a plate-shaped member slidably disposed at the chassis to push the second clutch gear into the power-connected position when pushed by the carrier. The actuator can further have a cushioning member preventing an excessive shock power from acting on the clutch when pushed by the carrier.

Also, the apparatus further includes a stopper member restricting the eccentric rotation gear to rotate between at least two positions. The stopper member includes a projection formed at the chassis to protrude toward the eccentric rotation gear, and two counter-projections formed on a movement path of the projection formed at one side surface of the eccentric rotation gear to be engaged with the projection when the eccentric rotation gear is rotated.

BRIEF DESCRIPTION OF THE DRAWINGS

These and other objects and advantageous of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
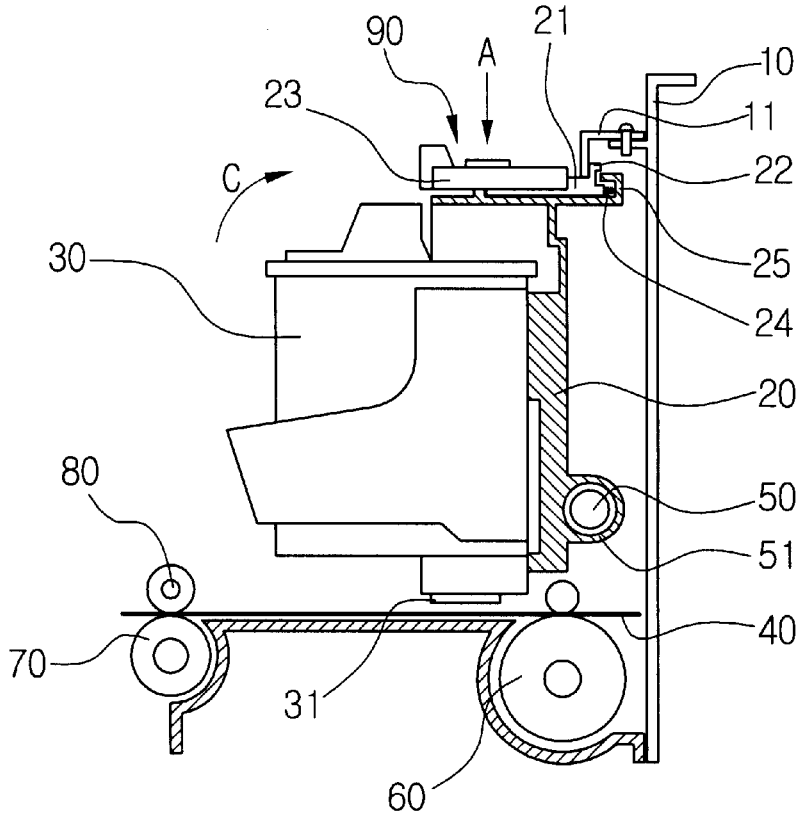
FIG. 1 (PRIOR ART)
FIG. 1 is a side cross-sectional view of a carrier assembly of a conventional inkjet printer.
Figure 2:
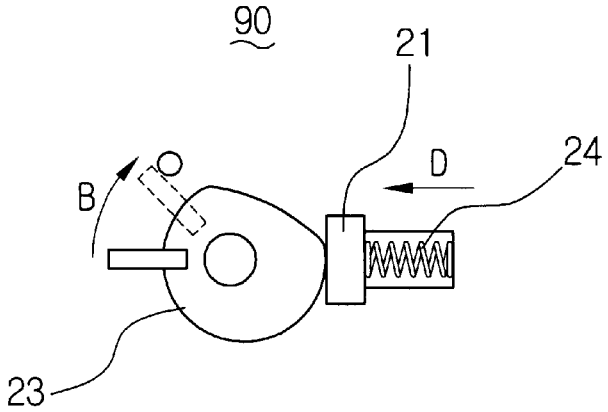
FIG. 2 (PRIOR ART)
FIG. 2 is a top plan view of an apparatus for adjusting a head gap of the carrier assembly shown along a direction'A'of FIG. 1.
Figure 3:
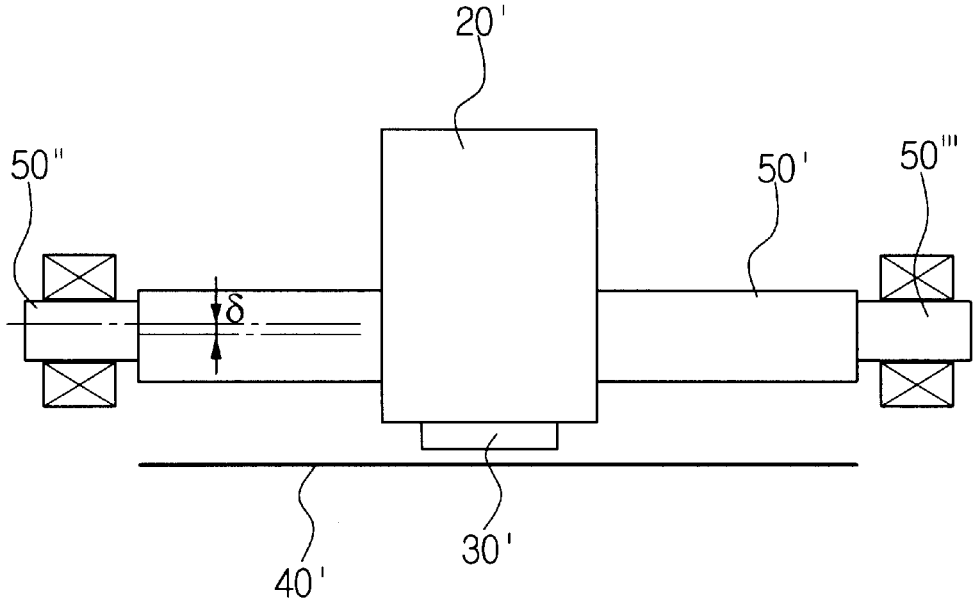
FIG.3 (PRIOR ART)
FIG. 3 is a schematic view of an apparatus for adjusting a head gap of another conventional inkjet printer.

Reference will now be made in detail to the present preferred embodiments of the present invention, examples of which are illustrated in the accompanying drawings, wherein like reference numerals refer to the like elements throughout. The embodiments are described in order to explain the present invention by referring to the figures.

The present invention now will be described more fully hereinafter with reference to the accompanying drawings, in which a preferred embodiment of the invention is shown. Like numbers refer to like elements throughout.

Figure 4:
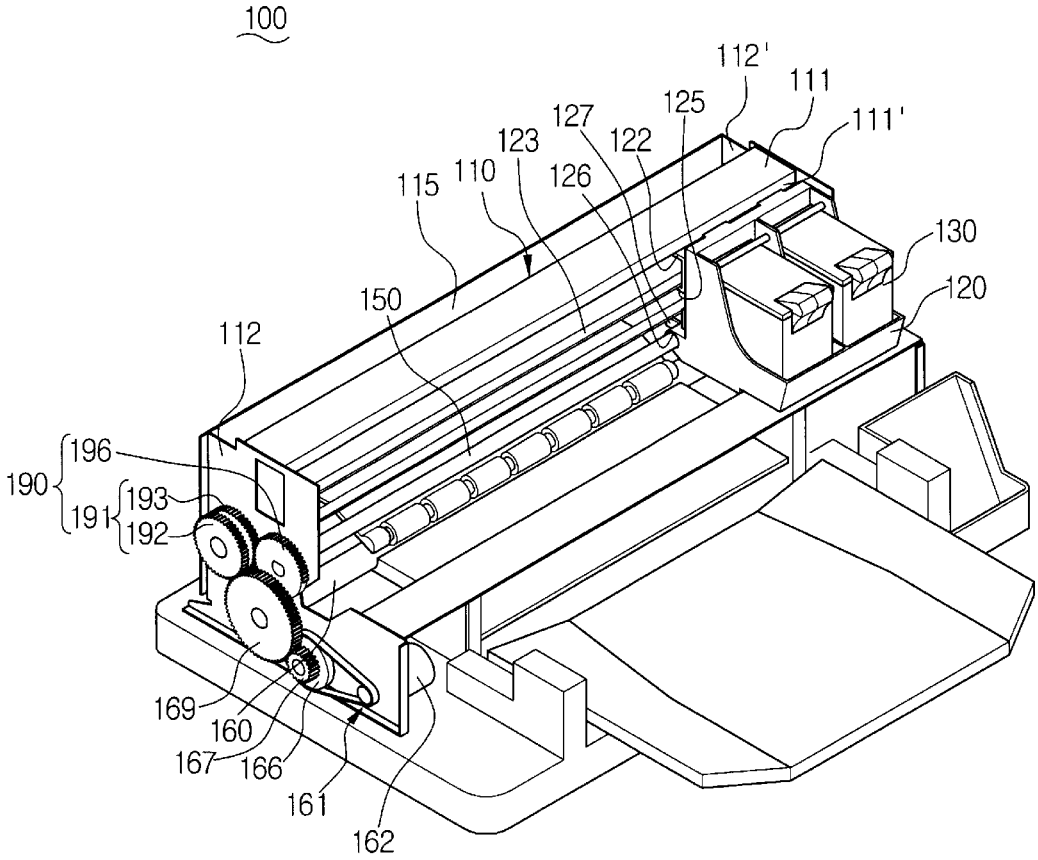
FIG. 4 is a partial perspective view of an inkjet printer having an apparatus for adjusting a head gap in accordance with an embodiment of the present invention.
Figure 5:
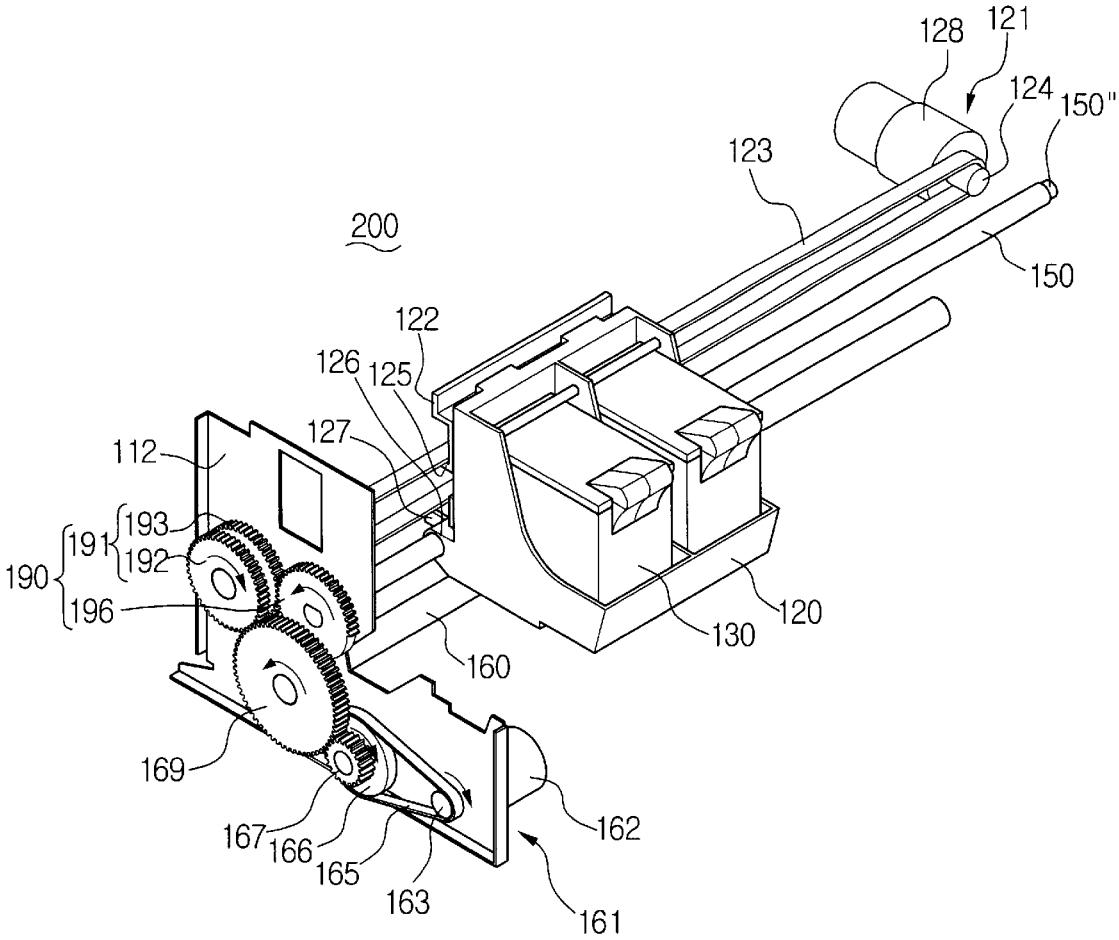
FIG. 5 is a partial perspective view of the apparatus for adjusting the head gap shown in FIG. 4.

Referring now to FIGS. 4 and 5, there is illustrated an inkjet printer 100 in which an apparatus for adjusting a head gap is installed in accordance with an embodiment of the present invention.

The inkjet printer 100 includes a carrier 120 mounted with a printing head 130 having a nozzle to eject ink on printing paper, a chassis 110 having side frames 112, 112' supporting a guide rail 111 and a carrier shaft 150 guiding a movement of the carrier 120, a carrier driving part 121 moving the carrier 120 right and left along the carrier shaft 150, and a paper-transporting roller driving part 161 driving a paper-transporting roller 160 to transport the printing paper to be printed, and an apparatus 200 adjusting a head gap between the printing paper and the nozzle of the printing head 130 by rotating and ascending/descending the carrier shaft 150.

The carrier 120 is provided with a guide slider 122 formed at a rear side of an upper part thereof to be movable right and left while an upper portion of the carrier 120 is contact with a vertical wall 111' of the guide rail 111, and a supporting bracket 126 receiving and supporting the carrier shaft 150 to be movable right and left with respect to the chassis 10.

As shown in FIG. 5, the carrier driving part 121 includes a carrier driving motor 128 fixed on a rear frame 115 of the chassis 110, and a carrier driving belt 123 connected with a driving gear 124 of the carrier driving motor 128 to transmit a driving force of the carrier driving motor 128 to a power transmitting-saw tooth 125 formed at the rear side of the carrier 120 to move the carrier 120 right and left along the carrier shaft 150.

The paper-transporting roller driving part 161 includes a paper-transporting roller driving motor 162 fixed at a lower part of the side frame 112, a power-transmitting pulley 166 connected to a driving pulley 163 of the paper-transporting roller driving motor 162 through a power-transmitting belt 165, a power-transmitting gear 167 coupled to the power transmitting pulley 166, and a paper-transporting roller driving gear 169 engaged with the power-transmitting gear 167.

The apparatus 200 for adjusting the head gap, as shown in FIGS. 6A, 6B, 6C and 8, includes a carrier ascent/descent part 113 ascending and descending the carrier 120 mounted with the printing head 130, and a clutch device 190, 201 selectively transmitting a driving force of the paper-transporting roller driving part 161 to the carrier shaft 150 through the carrier ascent/descent part 113 in order to ascend and descend the carrier 120 by rotating the carrier shaft 150 with respect to the carrier 120 to adjust the head gap.

Figure 8:
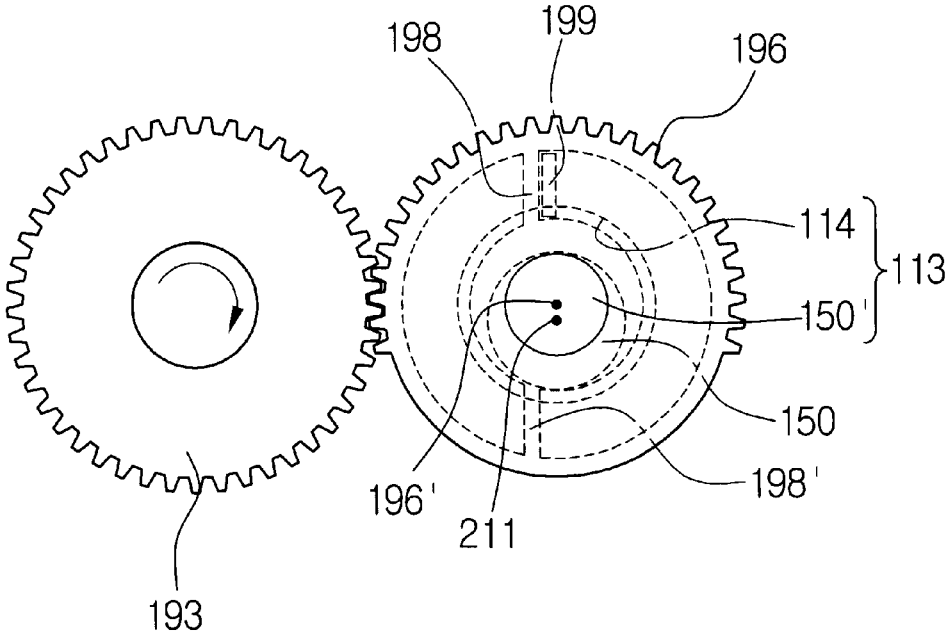
FIG. 8 is a partial side view illustrating an operation of a carrier ascent/descent part and the eccentric rotation gear of the apparatus for adjusting the head gap shown in FIG. 4.

As shown in FIG. 8, the carrier ascent/descent part 113 includes both ends 150', 150" of the carrier shaft 150 formed in the form of an eccentric cam which a center axis 196' (FIG. 8) thereof is eccentrically positioned as much as a given amount with respect to a center axis 211 of the carrier shaft 150, and supporting bushings 114 formed in the side frames 112, 112' of the chassis 110, respectively, to receive and support both ends 150', 150" of the carrier shaft 150.

Both ends 150', 150" of the carrier shaft 150 are each formed with a circle-shaped cross section. To rotate the carrier shaft 150 through an eccentric rotation gear 196 as will be described hereinafter, one end 150' of the carrier shaft 150 is fixedly connected in a supporting hole 159 (FIG. 7) of the eccentric rotation gear 196 by a welding or a coupling key (not shown).

Accordingly, when both ends 150', 150" of the carrier shaft 150 formed in the form of an eccentric cam which the center axis 196' thereof is eccentrically positioned as much as a given amount with respect to the center axis 211 of the carrier shaft 150 are rotated in the supporting bushings 114 by a clutch part 190 and the eccentric rotation gear 196 as will be described hereinafter, the carrier shaft 150 is rotated about the center axis 196' of both ends 150', 150" thereof, and thereby the carrier shaft 150 and the carrier 120 moving right and left along the carrier shaft 150 inserted into the supporting bracket 126 of the carrier 120 is ascended upward or descended downward as much as a movement distance of the center axis 211 of the carrier shaft 150 in the vertical direction, i.e., finally two times as much as an amount of the eccentricity of the center axis 196' of both ends 150', 150" of the carrier shaft 150.

At this time, the guide slider 122 of the carrier 120 is vertically guided along the vertical wall 111 ' of the guide rail 111, so that the nozzle of the printing head 130 mounted in the carrier 120 is guided to be ascended or descended at a horizontally oriented state without being tilted back and forth.

Referring to FIGS. 5, 6A, 6B and 6C, the clutch device 190, 201 includes a clutch part 190 selectively transmitting the driving force of the paper-transporting roller driving gear 169 to the carrier shaft 150, and an actuator 201 actuating the clutch part 190 to transmit the driving force of the paper-transporting roller driving gear 169 to the carrier shaft 150 through the carrier ascent/descent part 113.

The clutch part 190 includes an eccentric rotation gear 196 formed at one end 150' of the carrier shaft 150, and a clutch 191 disposed at the side frame 112 to selectively-connect the paper-transporting roller driving gear 169 to the eccentric rotation gear 196.

Figure 7:
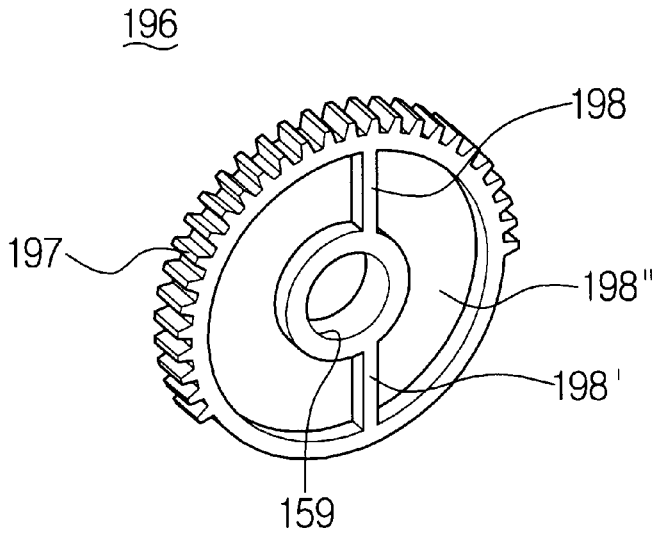
FIG. 7 is a perspective view of an eccentric rotation gear of the apparatus for adjusting the head gap shown in FIG. 4.

As shown in FIG. 7, the eccentric rotation gear 196 includes a circumferential surface with a partial toothed portion 197, which is engaged with a second clutch gear 193. The toothed portion 197 is partially formed on the circumferential surface of the eccentric rotation gear 196 because the carrier shaft 150 is not necessarily rotated at a full angle of 360° to ascend and descend the carrier 120.

At one side surface of the eccentric rotation gear 196, a recess 198" provides a space in which a projection 199 of a stopper member mounted on the side frame 112 is movable between two partition walls 198, 198'formed in the recess 198" to restrict a rotation of the eccentric rotation gear 196 by engaging with the projection 199.

The clutch 191 includes an axle 194 fixed at the side frame 112, a first clutch gear 192 rotatably supported on the axle 194 and having a toothed portion formed on a second circumferential surface thereof to be engaged with the paper-transporting roller driving gear 169, a second clutch gear 193 rotatably supported on the axle 194 and having a toothed portion formed on a third circumferential surface thereof to be engaged with the eccentric rotation gear 196, and an elastic spring 195 supported on the axle 194 between the first and second clutch gears 192, 193.

The first and second clutch gears 192, 193 have jagged or toothed clutch portions formed at respective surfaces facing each other. The second clutch gear 193 is movable between a power-connected position (FIG. 6C) to be engaged with the first clutch gear 192 and the eccentric rotation gear 196 and a power-disconnected position (FIG. 6A) to be separated from the first clutch gear 192, but in a normal printing operation or after the head gap is adjusted, the second clutch gear 193 is positioned in the power-disconnected position by the elastic spring 195.

It is preferable that the elastic spring 195 is positioned between the first and clutch gears 192, 193. Alternatively, however, the elastic spring 195 can be supported on an end of the axle 194 passing through the first clutch gear 192 to push the second clutch gear 193 to be elastically disposed in the power-disconnected position.

Figure 6A:
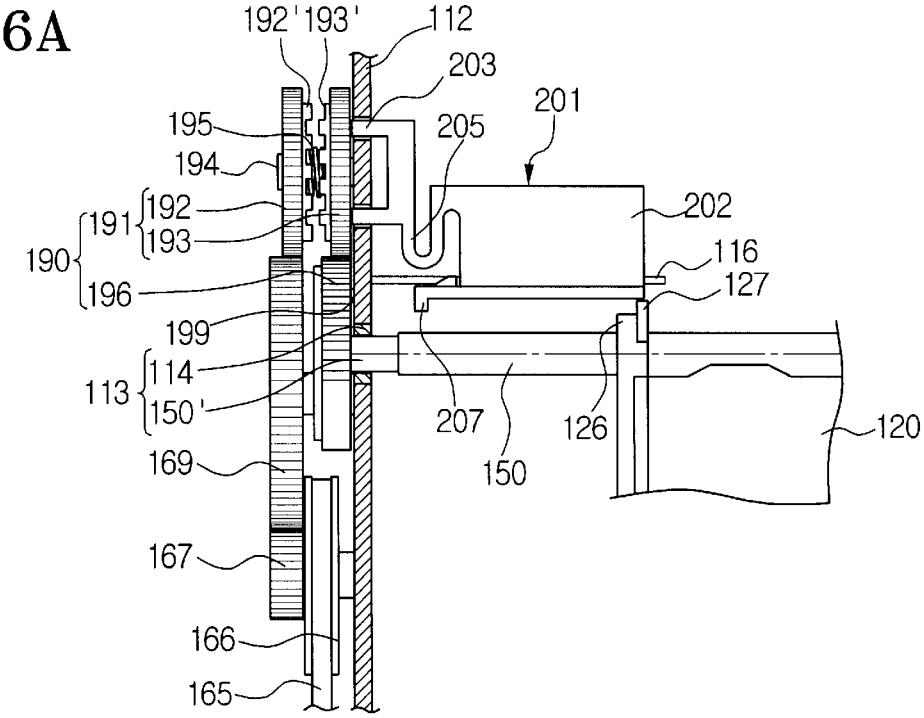
FIGS. 6A, 6B and 6C are partial cross-sectional views illustrating an operation of the apparatus for adjusting the head gap shown in FIG. 4.
Figure 6B:
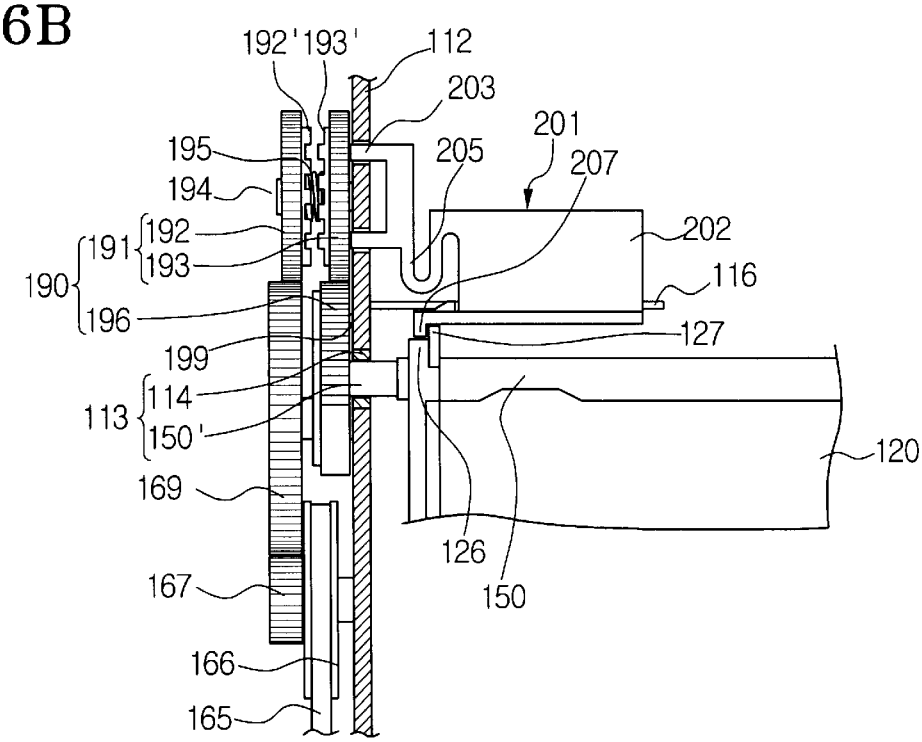
Figure 6C:
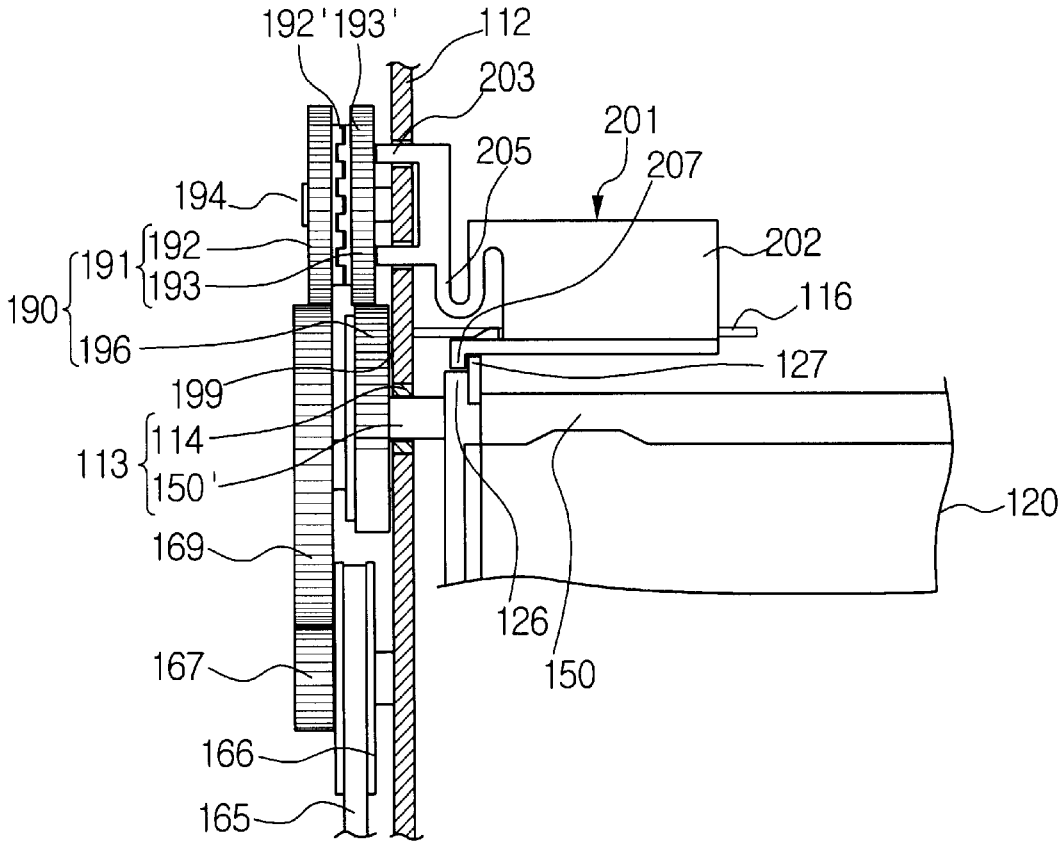

As shown in FIGS. 6A, 6B and 6C, the actuator 201 includes a plate-shaped member, which is slidably disposed on a guide 116 of the side frame 112 to push the second clutch gear 193 into the power-connected position when pushed by the carrier 120. The actuator 201 has a collision-contacting portion 207 disposed to be in contact with an actuating projection 127 formed at the supporting bracket 126 of the carrier 120, a moving slide 202 slidably disposed on the guide 116 of the side frame 112, and a C-shaped actuating rod 203 transmitting a moving or shock power of the actuating projection 127 to the second clutch gear 193.

Alternatively, the actuator 201 can further include a cushioning member 205 partially absorbing the shock power and preventing the shock power from excessively exerting on the clutch 191 when the actuating projection 127 comes in collision (contact) with the collision contacting portion 207. The cushioning member 205 is formed of a U-shaped plate, so that the moving slide 202 is elastically connected to the C-shaped actuating rod 203.

A controller (not shown) is provided in the inkjet printer to be connected to a head gap adjusting button (not shown), the carrier driving motor 128, and the paper-transporting roller driving motor 162. The controller controls the paper transporting roller driving motor 162 to transport the printing paper or to adjust the head gap by controlling the carrier ascent/descent part 13 through the clutch device 190. The controller controls the carrier driving motor 128 to move the carrier 120 in a resting position or a head adjusting position. The rest position and the head gap adjusting position of the carrier 120 may be disposed on the same side or opposite sides of the carrier shaft 150. When the carrier 120 is disposed in the head adjusting position, the controller stops transporting the printing paper and controls the paper-transporting roller driving motor 62 to move the carrier shaft 150 and the carrier in a direction perpendicular to a paper transporting direction or with respect to the center axis 196' of the both ends 150', 150" of the carrier shaft 150 in response to a contact between the collision-contacting portion 207 of the actuator 210 and the actuating projection 127 of the carrier 120.

Also, as shown in FIG. 8, the apparatus 200 for adjusting the head gap includes stopper members 198, 198', 199 restricting the eccentric rotation gear 196 fixing one end 150' of the carrier shaft 150 in the supporting hole 159 to be rotated only between two positions. The stopper member includes the projection 199 projected toward the eccentric rotation gear 196 from the side frame 112, and the two partition walls 198, 198' formed in the recess 198" of the eccentric rotation gear 196.

The partition walls 198, 198' are formed at a certain interval, for example an angle of 180° corresponding to positions in which one of the partition walls 198, 198' comes in contact with the projection 199 in the recess 198" when the carrier 120 is completely ascended and descended, respectively. The one of the partition walls 198, 198' stops the rotation of the eccentric rotation gear 196 when being engaged with the projection 199. More specifically, the positions in which the partition walls 198, 198' are formed are the positions which correspond to a "WIDE" mode for envelope, postcard and the like and a "NARROW" mode for the general paper. In the "WIDE" mode and the "NARROW" mode, the carrier 120 is ascended and descended to increase and decrease the head gap, respectively, according to the amount of the eccentricity when the both ends 150', 150" of the carrier shaft 150 are rotated in the supporting bushings 114.

Accordingly, in the state that the second clutch gear 193 is positioned at the power-connected position to be engaged with the first clutch gear 192 and the eccentric rotation gear 196 to adjust the head gap, the paper-transporting roller driving motor 162 is operated to rotate the eccentric rotation gear 196 only at the angle of 180° between two partition walls 198, 198' by the projection 199.

An adjusting operation of the apparatus 200 for adjusting a head gap in accordance with the embodiment of the present invention will now be explained with reference to FIGS. 4, 6A, 6B, and 6C.

First, when a user pushes the head gap adjusting button of the control panel, or when a present mode state of the head gap does not coincide with data, such as kinds of the printing paper inputted through the control panel by the user, the controller of the inkjet printer generates a head gap adjustment command.

At this time, assuming that the present mode state of the head gap is the "NARROW" mode for general paper and that a head gap mode to be adjusted is the "WIDE" mode for envelope, postcard and the like the carrier driving motor 128 as shown in FIG. 6A is operated to move the carrier 120 to the adjusting position, in which the actuator 201 is disposed, across a printing area by using a driving belt 123 and a power transmitting-saw tooth 125 according to the command of the controller.

As shown in FIG. 6B, when the carrier 120 moves in the adjusting position, the actuating projection 127 of the carrier 120 comes in contact with a collision-contacting portion 207 of the actuator 201. The an actuating rod 203 of the actuator 201 pushes the second clutch gear 193 to move into a power-connected position to be engaged with the first clutch gear 192 against an elastic force of the elastic spring 125. An excessive shock power is exerted on the collision-contacting portion 207 by the actuating projection 127 and is absorbed by the cushioning member 205 of the actuator 201.

As shown in FIG. 6C, when the carrier 120 is stopped after the second clutch gear 193 is completely engaged with the first clutch gear 192, the controller controls a paper-transporting roller driving motor 162 to be rotated, for example in a clockwise direction, thereby to rotate the first clutch gear 192 clockwise via the power-transmitting pulley 166, the power-transmitting gear 167 and the paper-transporting roller driving gear 169. As a result, the second clutch gear 193 is rotated clockwise, and the eccentric rotation gear 196 engaged with the second clutch gear 193 is rotated counterclockwise about the center axis 196' of one ends 150' of the carrier shaft 150.

As the eccentric rotation gear 196 is rotated counterclockwise, both ends 150', 150" of the carrier shaft 150 having the eccentric center axis 196' to form the eccentric cam are rotated in the supporting bushings 114. As a result, the carrier shaft 150 is rotated in the supporting bracket 126 about the center axes 196' of both ends 150', 150" thereof, and thereby vertically ascended as much as a movement distance of the center axis 211 of the carrier shaft 150 in the vertical direction.

As the carrier shaft 150 is ascended, the carrier 120 supported on the carrier shaft 150 is also moved upwardly. At this time, the carrier 120 is guided to move vertically along a vertical wall 111' of a guide rail 111 by using a guide slide 122 thereof, so that a nozzle of printing head 130 mounted in the carrier 120 is horizontally maintained without being tilted with respect to the printing paper.

When the eccentric rotation gear 196 is rotated at an angle of about 180°, the projection 199 formed on the side frame 112 is engaged with a partition wall 198', and thereby the rotation of the eccentric rotation gear 196 is restricted and the paper-transporting roller driving motor 162 is stopped by the controller. At this time, the carrier 120 is completely ascended to a position corresponding to the "WIDE" mode which the head gap between the printing paper and the nozzle of the printing head 130 is maintained to be adapted to print the envelope, the postcard and the like.

After that, the carrier 120 is again moved to the position shown in FIG. 6B by the controller, and thereby the second clutch gear 193 is returned to the power-disconnected position in which the second clutch gear 193 is engaged with the eccentric rotation gear 196 but disconnected from the first clutch gear 192 by the elastic spring 195. At this time, since the second clutch gear 193 can not be easily separated from the first clutch gear 192 due to a surface friction between jagged clutch portions thereof, the paper-transporting roller driving motor 162 is driven to rotate the first clutch gear 192 counterclockwise at a slightly given angle.

Also, at this time, the eccentric rotation gear 196 is maintained in the position without freely moving by a contact between the supporting bushings 114 and the circumferencial surface of the cam of respective ends 150', 150" of the carrier shaft 150, the elastic force of the elastic spring 195 pushing the second clutch gear 193 toward the side frame 112, and the engagement of the stopper members 198', 199, and the like.

Thereafter, the carrier 120 is moved into the printing area to perform the printing operation according to a printing command of the controller.

The adjusting operation of adjusting the head gap into the "NARROW" mode is performed in a reverse order to what is described above.

As is apparent from the foregoing description, it can be appreciated that the apparatus for adjusting the head gap in accordance with the embodiment of the present invention can automatically adjust the head gap between the printing paper and the printing head by using only the driving force of the carrier driving motor and the paper-transporting roller driving motor without using a separate additional driving motor.

In the drawings and specification, there have been disclosed a typical preferred embodiment of the invention and, although specific terms are employed, they are used in a generic and descriptive sense only and not for purpose of limitation, the scope of the invention being set forth in the following claims.

Although a few preferred embodiments of the present invention have been shown and described, it would be appreciated by those skilled in the art that changes may be made in this embodiment without departing from the principles and sprit of the invention, the scope of which is defined in the claims and their equivalents.

What is claimed is:

1. An apparatus for adjusting a gap between a printing paper and a nozzle of a printing head in an inkjet printer having a carrier mounted with the printing head, a chassis having a carrier shaft guiding a movement of the carrier, a carrier driving part moving the carrier along the carrier shaft, and a paper-transporting roller driving part driving a paper-transporting roller to transport printing paper to be printed, comprising:

a carrier ascent/descent part ascending and descending the carrier by rotating the carrier shaft; and a clutch unit transmitting a driving force of the paper-transporting roller driving part to the carrier shaft and disposed to be actuated by the carrier which is moved by the carrier driving part when the gap is to be adjusted.

2. The apparatus according to claim 1, wherein the clutch unit comprises, a clutch part selectively transmitting the driving force of the paper-transporting roller driving part to the carrier shaft; and an actuator actuating the clutch part to transmit the driving force of the paper-transporting roller driving part to the carrier shaft.

3. The apparatus according to claim 2, wherein the clutch part comprises:

an eccentric rotation gear formed at one end of the carrier shaft; and a clutch disposed at the chassis to selectively connect the paper-transporting roller driving part to the eccentric rotation gear.

4. The apparatus according to claim 3, wherein the carrier ascent /descent part comprises:

both ends of the carrier shaft formed of in the form of an eccentric cam which a center axis thereof is eccentrically positioned as much as a given amount from a center axis of the carrier shaft, supporting bushings formed on the chassis to support each end of the carrier shaft rotatably and ascendably/descendably.

5. The apparatus according to claim 4, wherein the clutch comprises:

a first clutch gear engaged with the paper-transporting roller driving part;

a second clutch gear coaxially connected with the first clutch gear and disposed to be movable between a power-connected position engaged with the first clutch gear and the eccentric rotation gear and a power-disconnected position separated from the first clutch gear; and an elastic spring elastically pushing the second clutch gear to be disposed in the power-disconnected position.

6. The apparatus according to claim 5, wherein the actuator comprises:

a plate-shaped member slidably disposed at the chassis to push the second clutch gear into the power-connected position in response to a movement of the carrier.

7. The apparatus according to claim 6, wherein the actuator comprises:

a cushioning member preventing an excessive shock power from being exerted on the clutch when pushed by the carrier.

8. The apparatus according to claim 7, further including a stopper member restricting the eccentric rotation gear to rotate between at least two positions.

9. The apparatus according to claim 8, wherein the stopper member comprises:

a projection formed at the chassis to be projected toward the eccentric rotation gear; and two counter-projections formed on the eccentric rotation gear to contact the projection when the eccentric rotation gear is rotated, and one of the wo counter-projections of the eccentric rotation gear being engaged with the projection.

10. An apparatus in an inkjet printer having a carrier shaft and a carrier mounted with a printing head, comprising:

a carrier driving part driving the carrier to move along the carrier shaft toward a head gap adjusting position;

a paper-transporting roller driving part generating a driving force to transport printing paper along a printing paper passage and to move the carrier shaft; and a carrier ascent and descent part moving the carrier shaft with respect to the printing paper passage in response to the driving force of the paper-transporting roller driving part to adjust a head gap between the printing head and the printing paper.

11. The apparatus according to claim 10, further comprising a clutch device disposed between the paper-transporting roller driving part and the carrier ascent and descent part to selectively transmit the driving force of the paper-transporting roller driving part to the carrier ascent and descent part.

12. The apparatus according to claim 11, further comprising an actuator disposed between the clutch and the carrier to control the clutch to transmit the driving force of the paper-transporting roller driving part to the carrier ascent and descent part in response to a movement of the carrier toward the head gap adjusting position by the carrier driving motor.

13. The apparatus according to claim 10, wherein the carrier ascent and descent part moves the carrier away from and close to the printing paper passage in a direction perpendicular to the printing paper passage.

14. The apparatus according to claim 10, wherein the carrier driving part and the paper-transporting roller driving part are disposed on opposite sides of the carrier shaft.

15. The apparatus according to claim 10, wherein the carrier ascent and descent part and the paper-transporting roller driving part are disposed on one end of the carrier shaft opposite to the carrier driving part disposed adjacent to the other end of the carrier shaft.

16. The apparatus according to claim 10, wherein the inkjet printer comprises a chassis having opposite side frames on which the carrier shaft is mounted, and the carrier driving part and the paper-transporting roller driving part are disposed on respective side frames.

17. The apparatus according to claim 10, wherein the inkjet printer comprises a chassis having opposite side frames on which the carrier shaft is mounted, and the carrier ascent and descent part and the paper-transporting roller driving part are disposed on the same side frame.

18. The apparatus according to claim 10, wherein the paper-transporting roller driving part controls the carrier ascent and descent part to adjust the head gap in response to the driving force when the paper-transporting roller driving part does not transport the printing paper along the printing paper passage.

19. The apparatus according to claim 10, wherein the apparatus comprises a paper-transporting roller transporting the printing paper along the printing paper passage in response to the driving force, and the paper-transporting roller driving part selectively drives one of the paper-transporting roller and the carrier ascent and descent part.

20. The apparatus according to claim 10, wherein the apparatus comprises an eccentric rotation gear selectively coupled to the paper-transporting roller driving part and having a portion coupled to one end of the carrier shaft, and the carrier ascent and descent part comprises:

a side frame formed on the inkjet printer and having a supporting bushing to receive the one end of the carrier shaft.

21. The apparatus according to claim 20, wherein the carrier shaft comprises a cam formed on the one end thereof to rotate within the supporting bushing of the side frame in response to the driving force of the paper transporting roller driving part.

22. The apparatus according to claim 21, wherein the cam comprises a center axis eccentric to that of carrier shaft.

23. The apparatus according to claim 10, wherein the apparatus comprises an eccentric rotation gear selectively coupled to the paper-transporting roller driving part and coupled to one end of the carrier shaft, and the carrier ascent and descent part comprises:

a side frame formed on the inkjet printer and having a supporting bushing receiving the one end of the carrier shaft; and a cam formed on the one end of the carrier shaft to rotate within the supporting bushing in response to the driving force of the paper-transporting roller driving part.

24. The apparatus according to claim 10, wherein the apparatus further comprises:

an eccentric rotation gear selectively coupled to the paper-transporting roller driving part and coupled to one end of the carrier shaft; and the carrier ascent and descent part comprises:

a supporting bushing formed on the carrier ascent and descent part to receive the one end of the carrier shaft, and a wall defining the supporting bushing to rotatably receive the one end of the carrier shaft.

25. The apparatus according to claim 24, wherein the one end of the carrier shaft comprises a cam rotating within the supporting bushing.

26. The apparatus according to claim 24, wherein the cam comprises a center axis eccentric to that of the carrier shaft.

27. The apparatus according to claim 10, wherein the apparatus comprises:

an eccentric rotation gear selectively coupled to the paper-transporting roller driving part and fixedly coupled to one of opposite ends of the carrier shaft; and the carrier ascent and descent part comprises:

a pair of side frames formed on the inkjet printer and each having a supporting bushing to receive respective one of the opposite ends of the carrier shaft, and a pair of cams formed on respective opposite ends of the carrier shaft to be rotated within respective supporting bushings in response to the driving force of the paper transporting roller driving part.

28. The apparatus according to claim 27, wherein the carrier ascent and descent part comprises a wall defining the supporting bushing, and one end of the carrier shaft rotates in the supporting bushing of the carrier ascent and descent part to move in a radial direction of carrier shaft when the eccentric rotation gear rotates in response to the driving force of the paper-transporting roller driving part.

29. The apparatus according to claim 10, wherein the apparatus comprises:

an eccentric rotation gear selectively coupled to the paper-transporting roller driving part and a portion of one end of the carrier shaft; and the carrier ascent and descent part comprises:

a pair of side frames formed on the inkjet printer and each having a wall defining a supporting bushing to receive the one end of the carrier shaft.

30. The apparatus according to claim 29, wherein the one end of the carrier shaft comprises a cam having a center axis eccentric to that of the carrier shaft.

31. The apparatus according to claim 10, further comprising:

a clutch disposed between the paper-transporting roller driving part and the carrier ascent and descent part;

an eccentric rotation gear coupled to the clutch and one end of the carrier shaft; and an actuator disposed to control the clutch to transmit the driving force to the eccentric rotation gear when the carrier moves to the head gap adjusting position to contact the actuator.

32. The apparatus according to claim 31, wherein the eccentric rotation gear having a tooth portion and a non-tooth portion at a circumferential side thereof to rotate when the tooth portion is engaged with the clutch.

33. The apparatus according to claim 32, wherein the eccentric rotation gear does not rotate at about an angle of 360 degrees but rotates at about an angle of 180 degrees.

34. The apparatus according to claim 31, wherein the apparatus comprises a side frame mounted with the clutch, the eccentric rotation gear, and the actuator.

35. The apparatus according to claim 34, wherein the eccentric rotation gear comprises a first wall defining a first hole formed around a center portion coupled to the one end of the carrier shaft, and the side frame comprises a stopper formed on the side frame to protrude into the first hole to restrict a rotation of the eccentric rotation gear when the stopper contacts a portion of the first wall.

36. The apparatus according to claim 35, wherein the first wall comprises a partition wall, and the eccentric rotation gear stops rotating when the stopper of the side frame contacts the partition.

37. The apparatus according to claim 36, wherein the first wall comprises an additional partition, and the partition and the additional partition are disposed at about an angle of 180 degrees about the center portion to restrict a rotation of the eccentric rotation gear between the partition and the additional partition.

38. The apparatus according to claim 35, wherein the side frame comprises a second wall defining a second hole coaxial to a center of the eccentric rotation gear, and the one end of the carrier shaft is fixedly coupled to the eccentric rotation gear and rotatably inserted into the second hole of the second wall of the side frame.

39. An apparatus in an inkjet printer having a printing head, a carrier driving motor moving the printing head, and a paper-transporting roller driving motor feeding printing paper, comprising:

a head gap adjusting unit automatically adjusting a head gap between the printing head and the printing paper using a driving force from the carrier driving motor and the paper-transporting roller driving motor without using a separate additional motor.

40. A method in an inkjet printer having a carrier shaft, a carrier slidably mounted on the carrier shaft, a carrier driving part controlling the carrier to move along the carrier shaft, and a paper-transporting roller driving part transporting printing paper along a printing paper passage, method comprising:

controlling the carrier driving part to drive the carrier to move along the carrier shaft toward a head gap adjusting position; and controlling the paper-transporting roller driving part to generate a driving force to move the carrier shaft with respect to the printing paper passage when the carrier is disposed in the head gap adjusting position.

41. The method according to claim 40, wherein the controlling of the paper-transporting roller driving part comprises:

selectively transmitting the driving force to the carrier shaft in response to a movement of the carrier; and terminating the transmitting of the driving force to the carrier shaft in response to the movement of the carrier from the head gap adjusting position to an outside of the head gap adjusting position.

42. A method in an inkjet printer having a printing head, a carrier driving motor moving the printing head, and a paper-transporting roller driving motor feeding printing paper, the method comprising:

automatically adjusting a head gap between a printing head and printing paper in response to a driving force of the carrier driving motor and the paper-transporting roller driving motor without using a separate additional motor.

* * * * *